US005910001A

United States Patent [19]

Takahashi et al.

[11] Patent Number: 5,910,001

[45] Date of Patent: Jun. 8, 1999

[54] METHOD FOR ADJUSTING ENGAGED CLEARANCE BETWEEN ROTORS OF SCREW COMPRESSOR AND APPARATUS THEREFOR

[75] Inventors: Kenichi Takahashi, Ryugasaki; Hiroyuki Matsuno, Haramachi; Hiroyasu Obata, Zama; Megumi Kawai, Ebina, all of Japan

[73] Assignee: Hitachi Techno Engineering Co., Ltd., Tokyo, Japan

[21] Appl. No.: 08/879,609

[22] Filed: Jun. 20, 1997

[30] Foreign Application Priority Data

Jul. 3, 1996 [JP] Japan ..... 8-173391
Dec. 20, 1996 [JP] Japan ..... 8-341615

[51] Int. Cl.[6] ..... F04C 18/16

[52] U.S. Cl. ..... 418/1; 418/201.1; 29/888.023

[58] Field of Search ..... 418/1, 201.1, 206.2; 29/888.023

[56] References Cited

FOREIGN PATENT DOCUMENTS

| | | | |
|---|---|---|---|
| 135256 | 3/1985 | European Pat. Off. . | |
| 58-67987 | 4/1983 | Japan | 418/201.1 |
| 5-71473 | 3/1993 | Japan | 418/201.1 |

OTHER PUBLICATIONS

Patent Abstracts of Japan, vol. 13 No. 418 (M–871) Sep. 18, 1989 JP 01155089 (Hitachi, Ltd.) Jun. 16, 1989.

Patent Abstracts of Japan vol. 16, No. 585 (M–1347) Dec. 25, 1992 & JP 04 232395 Honda Motor Company Aug. 20, 1992.

Patent Abstracts of Japan vol. 5, No. 155 (M–090) Sep. 30, 1981 & JP 56 083593 (Hitachi, Ltd.) Jul. 8, 1981.

*Primary Examiner*—John J. Vrablik
*Attorney, Agent, or Firm*—Antonelli. Terry, Stout & Kraus, LLP

[57] ABSTRACT

A method of adjusting the engaged clearance between rotors of a screw compressor which has a male rotor and a female rotor inside a casing, both of the rotors being rotated while maintaining a required very small clearance using timing gears fixed individually to the rotors through shrink fitting, wherein the very small clearance between the rotors is set to a required value by loosening the shrink fitting between one of the timing gears and the rotor on which the one of the timing gears is mounted, while movement of the other of the timing gears is being restricted; and intermittently applying torques to the rotor on which the one of the timing gears is mounted using a servo motor. In this way, it is possible to obtain a screw compressor in which a very small clearance between the rotors can be set to a required value in a short time, and in which high reliability in the symmetrizing adjustment and a high compressing performance can be obtained.

12 Claims, 9 Drawing Sheets

METHOD FOR ADJUSTING ENGAGED CLEARANCE BETWEEN ROTORS OF SCREW COMPRESSOR AND APPARATUS THEREFOR

BACKGROUND OF THE INVENTION

The present invention relates to a method and an apparatus for adjusting the engaged clearance between rotors of a screw compressor comprising a male rotor and a female rotor inside a casing, both of the rotors being rotated, while maintaining a required very small clearance, by means of timing gears fixed individually to the rotors by a shrink fit, and more particularly relates to a method and an apparatus for adjusting the engaged clearance between rotor of a screw compressor for setting a very small clearance between both rotors to a desired value in a short time.

A conventional method of adjusting the clearance between rotors of a screw compressor is disclosed in Japanese Patent Application Laid-Open No. 1-155089, where a very small clearance between the rotors is set using a rotating phase difference between male and female rotors as measured by an encoder or the like, under a condition in which one of the rotors is rotated in forward and backward directions, while the other of the rotors has a braking force applied thereto, under a state in which at least one of the timing gears is removed, which is referred to as a timing adjustment or symmetrizing adjustment.

The setting of a clearance is performed during the assembling process of the screw compressor. Oil hydraulic pressure is applied between one of the timing gears and the rotor on which the one of the timing gears is fixed to loosen the shrink fit between both elements while the movement of the other of the timing gears is being restricted. Then, relative positional displacement is produced between the one of the timing gears and the rotor to which the one of the timing gears is fixed by hitting the tooth surface of the one of the timing gears using a hammer, a shim (thickness gage) is inserted between the rotors to confirm whether the clearance between the rotors is at a required value (shim measurement), and the hammer hitting and the shim measurement are repeated to set the clearance between the rotors to the required value.

In the conventional method described above, there has been a problem in that not only does the shim measurement take a long time, since the setting of the clearance between the rotors (symmetrizing adjustment) is performed by hand, but also the reliability of the symmetrizing adjustment is low, since the accuracy of the symmetrizing adjustment is disturbed by the hammering, which depends on the skill of the worker, leading to rotor hitting or low performance of the compressor as a result.

SUMMARY OF THE INVENTION

An object of the present invention is to provide a method and an apparatus for adjusting the clearance between rotors of a screw compressor, in which a very small clearance between the rotors can be set to a required value in a short time, and which exhibits a high reliability in the symmetrizing adjustment and a high compressing performance.

The above object of the present invention can be attained by providing a method of adjusting the engaged clearance between rotors of a screw compressor comprising a male rotor and a female rotor inside a casing, both of the rotors being rotated while maintaining a required very small clearance using timing gears fixed individually to the rotors by means of a shrink fit, the method comprising the steps of loosening the shrink fit between one of the timing gears and the rotor to which the one of the timing gears is fixed while movement of the other of the timing gears is being restricted; and intermittently applying torques to the rotor to which the one of the timing gears is fixed using a servo motor to set the very small clearance between the rotors to a required value.

Further, the above object of the present invention can be attained by providing a method of adjusting the engaged clearance between rotors of a screw compressor comprising a male rotor and a female rotor inside a casing, both of the rotors being rotated while maintaining a required very small clearance using timing gears fixed individually to the rotors by means of a shrink fit, the method comprising the steps of loosening the shrink fit between one of the timing gears and the rotor on which the one of the timing gears is fixed while movement of the other of the timing gears is being restricted; intermittently applying torques to the rotor to which the one of the timing gears is fixed using a servo motor; applying torques in forward and backward directions to the rotor during the intermittent torque application, each of the forward and backward torques being larger than a static friction force of the driving system of the servo motor and smaller than each torque intermittently applied; calculating a median value of the relative positions of the rotors during the application the forward and backward torques; and calculating a command value of an intermittent torque to be applied next from a difference between the median value and the required value for the very small clearance between the rotors.

Furthermore, the above object of the present invention can be attained by providing an apparatus for adjusting the engaged clearance between rotors of a screw compressor comprising a male rotor and a female rotor inside a casing, both of the rotors being rotated while maintaining a required very small clearance using timing gears fixed individually to the rotors by means of a shrink fit, which further comprises an intermittent torque applying means for loosening the shrink fit between one of the timing gears and the rotor to which the one of the timing gears is fixed, while movement of the other of the timing gears is being restricted, and intermittently applying torques based on command values to the rotor having the one of the timing gears fixed thereto using a servo motor; a forward and backward torque applying means for applying torques in forward and backward directions to the rotor during the intermittent torque application, each of the forward and backward torques being larger than a static friction force of the driving system of the servo motor and smaller than each torque intermittently applied; a relative position median value calculating means for calculating a median value of the relative positions of the rotors during the application of the forward and backward torques; and an intermittent torque calculating means for calculating the command value of an intermittent torque to be applied next from a difference between the median value and the required value for the very small clearance between the rotors.

It was confirmed from a study conducted by the present inventors that, prior to the present invention, a screw compressor could not be assembled to provide a clearance having a required value. That is, in assembling a screw compressor, when a shrink fit between one of the timing gears and the rotor to which the one of the timing gears is fixed was loosened by applying oil-hydraulic pressure between them, while movement of the other of the timing gears was being restricted, and a torque was applied to the rotor having the one of the timing gears through a servo motor in order to set a very small clearance between the rotors to a required value, the rotors were positioned at the target position while the servo motor was being operated (the very small clearance was at the required value), but the very small clearance between both rotors shifted from the target position when the servo motor was stopped, and, consequently, the screw compressor could not be assembled with a clearance at the required value.

The reason for this is believed to be as follows. That is, even though the shrink fit between the one of the timing gears and the rotor on which the one of the timing gears was fixed is loosened by applying oil-hydraulic pressure between them, there still exists some friction, and accordingly a high shrinking force, between the one of the timing gears and the rotor on which the one of the timing gears is fixed. Therefore, the rotor on which the one of the timing gears was fixed is elastically deformed under the condition where torque is applied by the servo motor. Consequently, when the servo motor is stopped, the elastic deformation is released, the rotor is returned to its natural shape and the very small clearance set between the rotors is lost as the rotor is moved from the target position.

The following method was employed in order solve the problem. That is, torques were intermittently applied to the rotor on which the one of the timing gears is mounted using a servo motor, the rotor was allowed to return to its natural shape between applications of the torque, and then a torque value to be applied the next time was determined based on the measured position of the rotor at that time. In that case, it was confirmed that the rotor did not completely return to its natural shape because the static friction force of the servo motor system operated as a restriction force against the rotor returning to its natural shape, and an error remained between the target value of the required very small clearance between the rotors and the actual value of the very small clearance between the rotors after the adjustment. Therefore, by applying torques, each of which is larger than a static friction force of the driving system of the servo motor and smaller than each of the torques intermittently applied, in forward and backward directions to the rotor during the intermittent torque application, a median value of relative positions of both rotors can be calculated during the application of the forward and backward torques. The median value corresponds to a median value of residual stresses in the forward and the backward directions caused in the rotor by the static friction force of the servo motor, which can be considered as a position of the rotor under a condition without elastic deformation. Therefore, by calculating a command value of an intermittent torque to be applied next from a difference between the median value and the required value for the very small clearance between the rotors (a preset value), the very small clearance between the both rotors can be adjusted to the target position as if the rotor having the one of the timing gears mounted thereon is in a state without elastic deformation. Accordingly, it is possible to obtain a screw compressor in which a very small clearance between the rotors can be set to a required value in a short time, and which exhibits a high reliability in the symmetrizing adjustment and a high compressing performance.

BRIEF DESCRIPTION OF THE DRAWINGS

FIGS. 11A to 11C are diagrams showing a rotating state of the timing gear portion of the screw compressor shown in FIG. 10; wherein FIG. 11A is a partial sectional view, FIG. 11B is a diagram showing an engaging state of the timing gears, and FIG. 11C is a diagram showing an engaging state of the M-timing gear and an outer gear.

FIGS. 12A and 12B are diagrams showing a rotating state of the rotor portion of the screw compressor shown in FIG. 10; wherein FIG. 12A is a schematic view, and FIG. 12B is a view showing an engaging state of the rotors.

DETAILED DESCRIPTION OF THE PREFERRED EMBODIMENTS

An embodiment of the present invention will be described with reference to the accompanying drawings.

Figure 1:
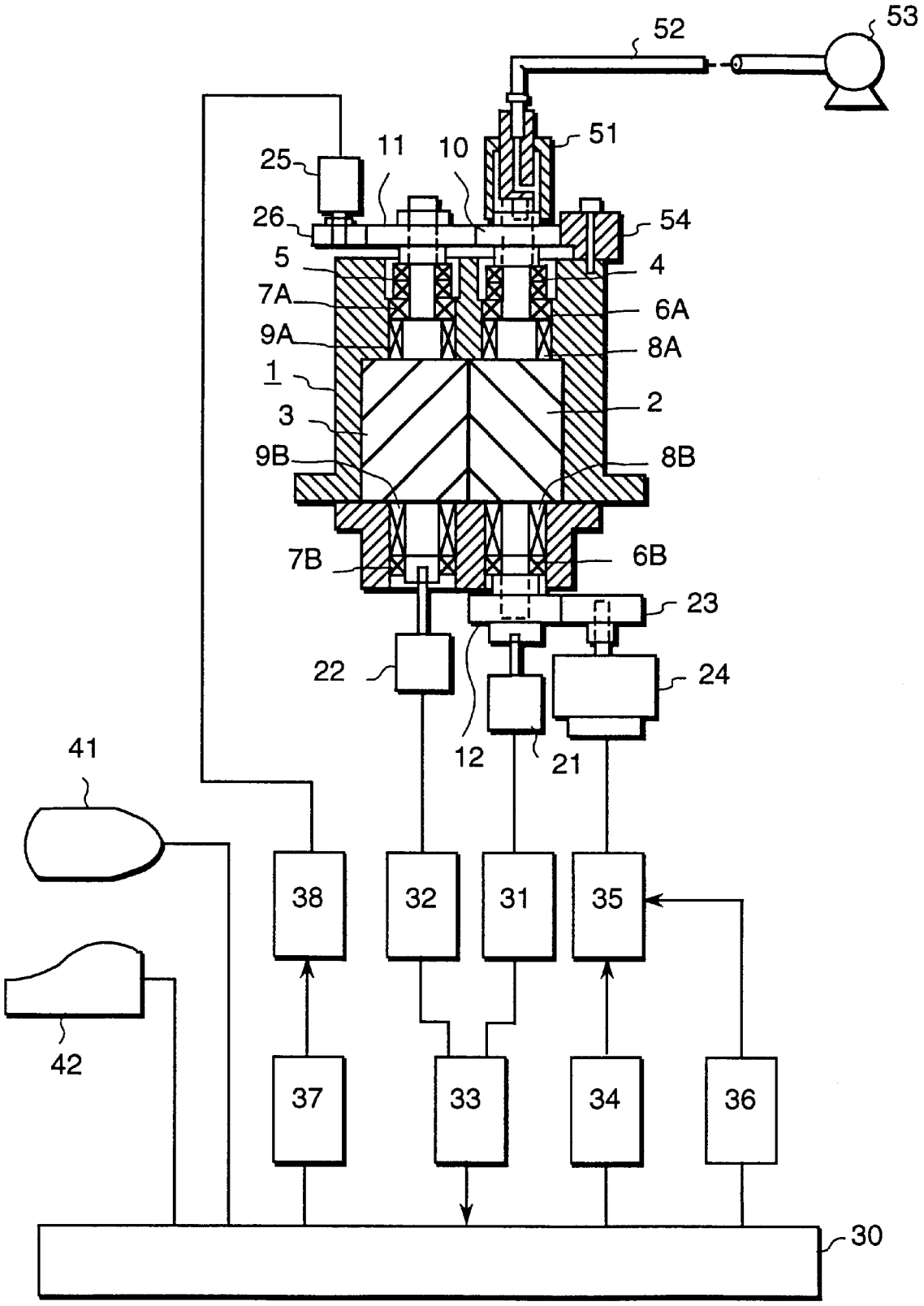
FIG. 1 is a block diagram showing an embodiment of an apparatus for adjusting the clearance between rotors of a screw compressor in accordance with the present invention.

FIG. 1 is a block diagram showing a screw compressor and an apparatus for adjusting the clearance between rotors of a screw compressor in accordance with the present invention. Referring to the figure, a casing 1 of the screw compressor houses a male rotor 2 and female rotor 3 which are supported in the thrust direction and in the radial direction through ball bearings 4, 5 and roller bearings 6A, 6B, 7A, 7B, respectively. The reference characters 8A, 8B, 9A, 9B denote seal rings, the reference character 10 denotes an M-timing gear of a helical gear fixed by shrink fit to an axle end portion (upper end in FIG. 1) on the delivery side of the male rotor 2, the reference character 11 denotes an F-timing gear of the helical gear fixed by shrink fit to an axle end portion (similarly, upper end in FIG. 1) in the delivery side of the female rotor 3, and the reference character 12 denotes a pinion gear fixed by shrink fit to an axle end portion (lower end in FIG. 1) on the suction side of the male rotor 2.

During normal operation of the screw compressor, by driving the pinion gear 12 using some means, the male rotor 2 and the M-timing gear 10 are rotated, and at the same time the F-timing gear 11 is driven by the M-timing gear 10 to rotate the female rotor 3 in the opposite direction to that of the male rotor 2. In the end surface portion of the casing 1 having both timing gears 10, 11 there is attached a bracket for receiving a thrust force applied to the ball bearing 4. Further, although the screw compressor is generally installed horizontally, the longitudinal direction thereof is shown in the vertical direction in FIG. 1 for convenience of illustration.

Figure 2A:
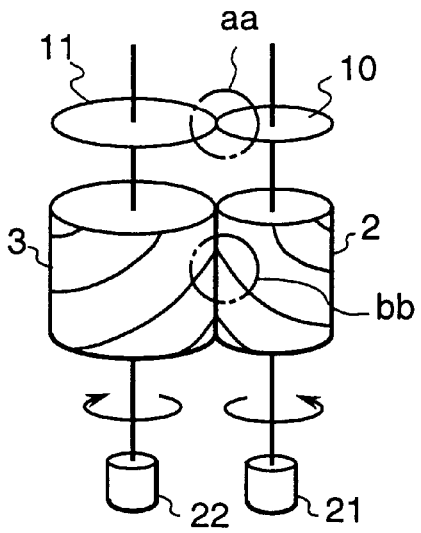
FIGS. 2A and 2B are schematic diagrams showing small clearances of rotors and timing gears in the screw compressor shown in FIG. 1.
Figure 2B:
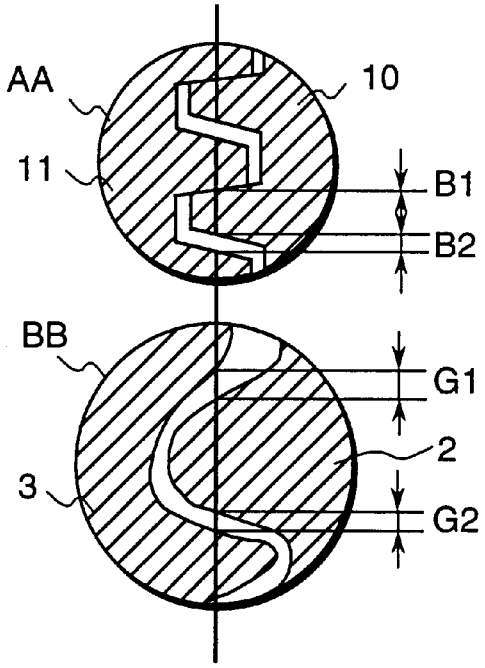

FIGS. 2A and 2B schematically show a state of the small clearances in the rotors and in the timing gears of the screw compressor shown in FIG. 1. An engaging portion (a portion surrounded by a chain line circle aa) of the M-timing gear 10 and the F-timing gear 11 in FIG. 2A is shown in an enlarged view by a circle AA in FIG. 2B, and an engaging portion (a portion surrounded by a chain line circle bb) of the male rotor 2 and the female rotor 3 in FIG. 2A is shown in an enlarged view by a circle BB in FIG. 2B. There is little clearance B1 between the gears 10, 11 on the forward side, and there is a larger clearance B2 on the backward side. Very small clearances G1, G2 are set on the forward side and the backward side of the rotors 2, 3, respectively. The very small clearances G1, G2 are varied by shifting the position of the M-timing gear 10 on the shaft of the male rotor 2.

What position the timing gear should be fixed at is described in Japanese Patent Application Laid-Open No. 1155089 as follows. As an example, the M-timing gear 10 is removed from the male rotor 2, the male rotor 2 is rotated forward and backward while the female rotor 3 has a braking force applied thereto through the F-timing gear 11, and the rotating phase difference of each of the rotors 2, 3 is measured using encoders 21, 22 connected to the rotors 2, 3, respectively, during the rotating period (hereinafter, this work is referred to as "measuring work"). Then, by calculating the very small clearances G1, G2 for the forward side and the backward side of both rotors using the measured result by which a desired compressing performance may be attained, the M-timing gear 10 is fixed to the male rotor 2 through a shrink fit so as to be set to the target position (hereinafter, this work is referred to as "adjusting work").

Figure 3:
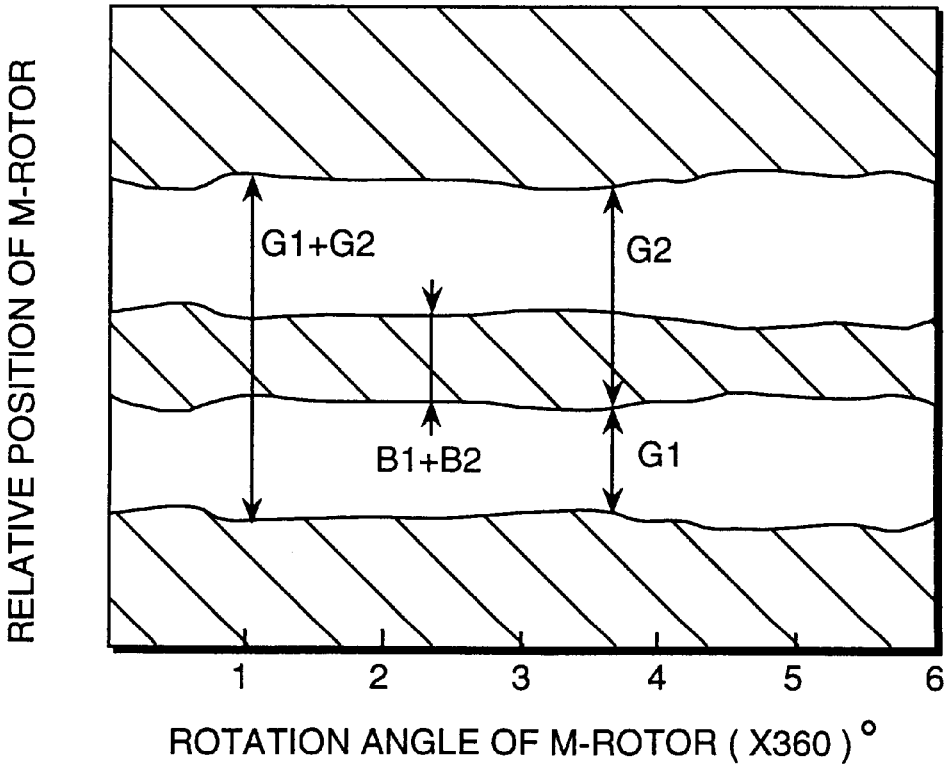
FIG. 3 is a diagram showing a state of setting the small clearances of the rotors and the timing gears to a required symmetrizing adjusting position in the screw compressor shown in FIG. 1.

FIG. 3 shows a state of setting of the small clearances of the rotors and the timing gears to a required symmetrizing adjusting position in the screw compressor.

Referring again to FIG. 1, a gear 23 is provided to drive the pinion gear 12 by way of a direct drive servo motor (hereinafter referred to as "DD motor") 24. The DD motor 24 is arranged at the bottom of the male rotor 2, where the M-timing gear 10 is not arranged, and applies intermittent torques to the male rotor through the pinion gear 12. A servo motor 25 is provided for restricting movement by applying a braking force to the F-timing gear 11 through a gear 26.

The apparatus for adjusting the engaged clearance between rotors in accordance with the present invention is composed of a plurality of means having the following functions.

(1) An intermittent torque applying means for loosening the shrinking between one of the timing gears and the rotor on which the one of the timing gears is fixed, while movement of the other of the timing gears is being restricted, and intermittently applying torques based on command values to the rotor on which the one of timing gears is mounted through use of the servo motor.

(2) A forward and backward torque applying means for applying torques in forward and backward directions to the rotor during the intermittent torque application, each of the torques being larger than a static friction force of the driving system of the servo motor and smaller than each torque intermittently applied.

(3) A relative position median value calculating means for calculating a median value of relative positions of the rotors during the application of the forward and backward torques.

(4) An intermittent torque calculating means for calculating the command value of an intermittent torque to be applied next from a difference between the median value and the required value for the very small clearance between both rotors.

The plurality of means having the above-mentioned functions may be realized by a central control unit (hereinafter referred to as "MPU") 30 and a program for adjusting the engaged clearance between rotors, which program is stored in a memory unit in the MPU (not shown).

According to the program for adjusting the engaged clearance between rotors, output pulses of the encoders 21, 22 individually connected to the rotors 2, 3 are supplied a counter 33 through interpolators 31, 32 for splitting each of them, and the difference between the rotating phases of the rotors 2, 3 is calculated in the MPU 30. The reference character 34 denotes a controller for rotating the DD motor 24 in forward and backward directions through a servo-amplifier 35 during the measuring work, and the reference character 36 denotes a D/A converter for converting a positional command output from the MPU 30 during the adjusting work and for driving the DD motor 24 through the servo-amplifier 35 to drive the male rotor 2 so that the male rotor 2 has a required clearance with respect to the female rotor 3, and the reference character 37 denotes a D/A converter for converting a torque command output from the MPU 30 during measuring work or during adjusting work and for driving the servo motor 25 through a servo-amplifier 38.

A monitor 41 is provided for displaying a state of processing in the MPU 30, and a printer 42 prints various kinds of data during the measuring work and adjusting work. The reference character 51 denotes a press-fitting jig for loosing the shrink fit of the M-timing gear 10 fixed to the male rotor 2 using hydraulic pressure supplied from an oil pressure pump 53 during measuring work or during adjusting work, and the reference character 54 denotes a jig for fixing (restricting the movement of) the M-timing gear 10 to the casing 1 during adjusting work so that the M-timing gear 10 is not rotated with respect to the male rotor 2.

Figure 4:
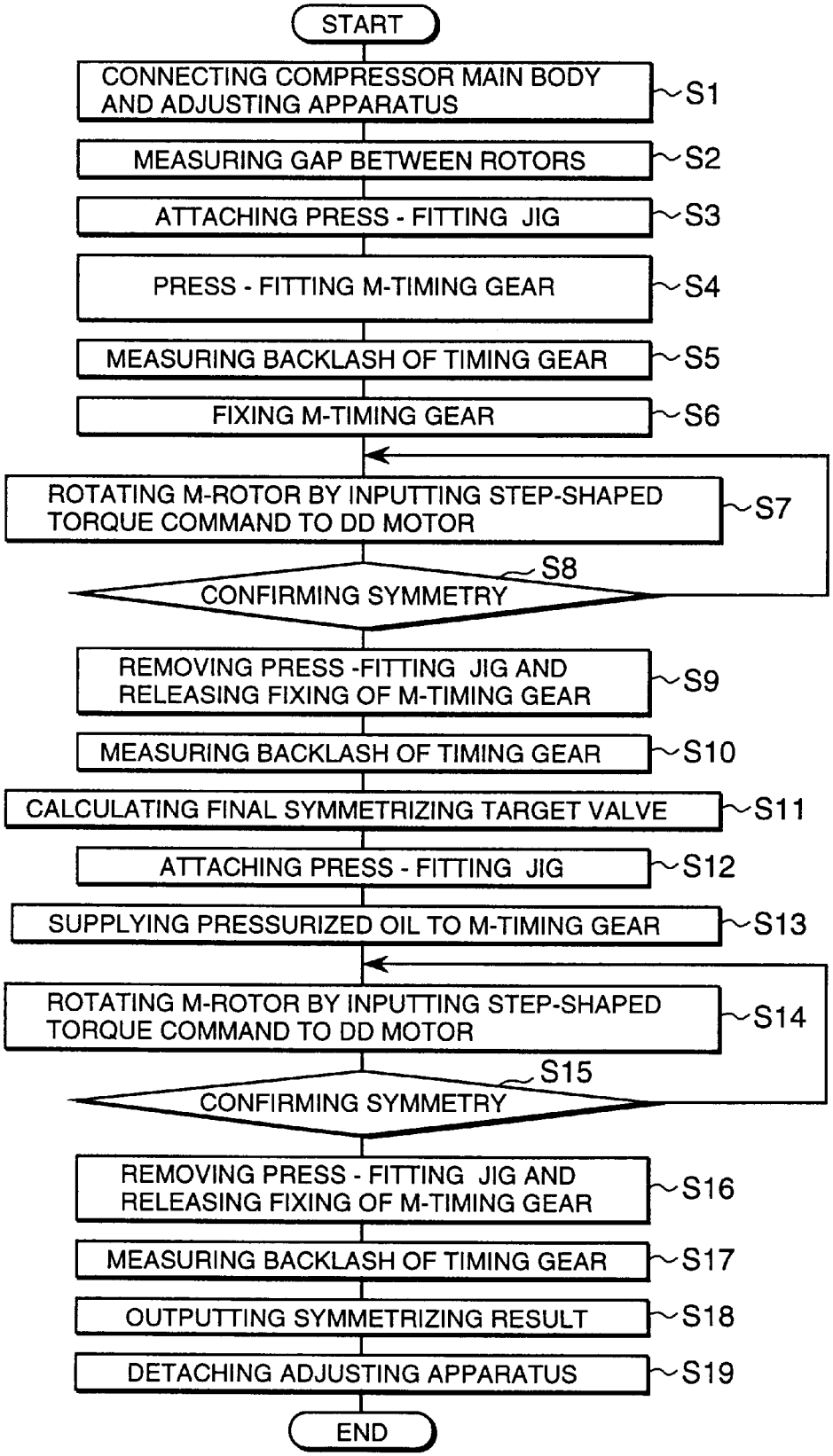
FIG. 4 is a flow diagram showing the process of adjusting the clearance between rotors of a screw compressor in accordance with the present invention.

Description now will be made concerning a method of adjusting the clearance between the rotors of a screw compressor using the apparatus for adjusting the engaged clearance of rotors, as shown in FIG. 1, with reference to the process flow of a program for adjusting the clearance between rotors in accordance with the present invention, as shown in FIG. 4.

Initially, in Step (hereinafter referred to as "S") 1, the various electrical units, such as the encoders 21, 22 and the servo motors 24, 25, are connected to the main body of a compressor, whose M-timing gear 10 is not fixed to the male rotor 2. Next, the following work is performed in S2.

The measuring work is performed by positioning control of the servo motor 24 using the controller 34. The explanation of the measuring work will be omitted here, since the details are disclosed in Japanese Patent Application Laid-Open No. 1-155089.

Figure 5:
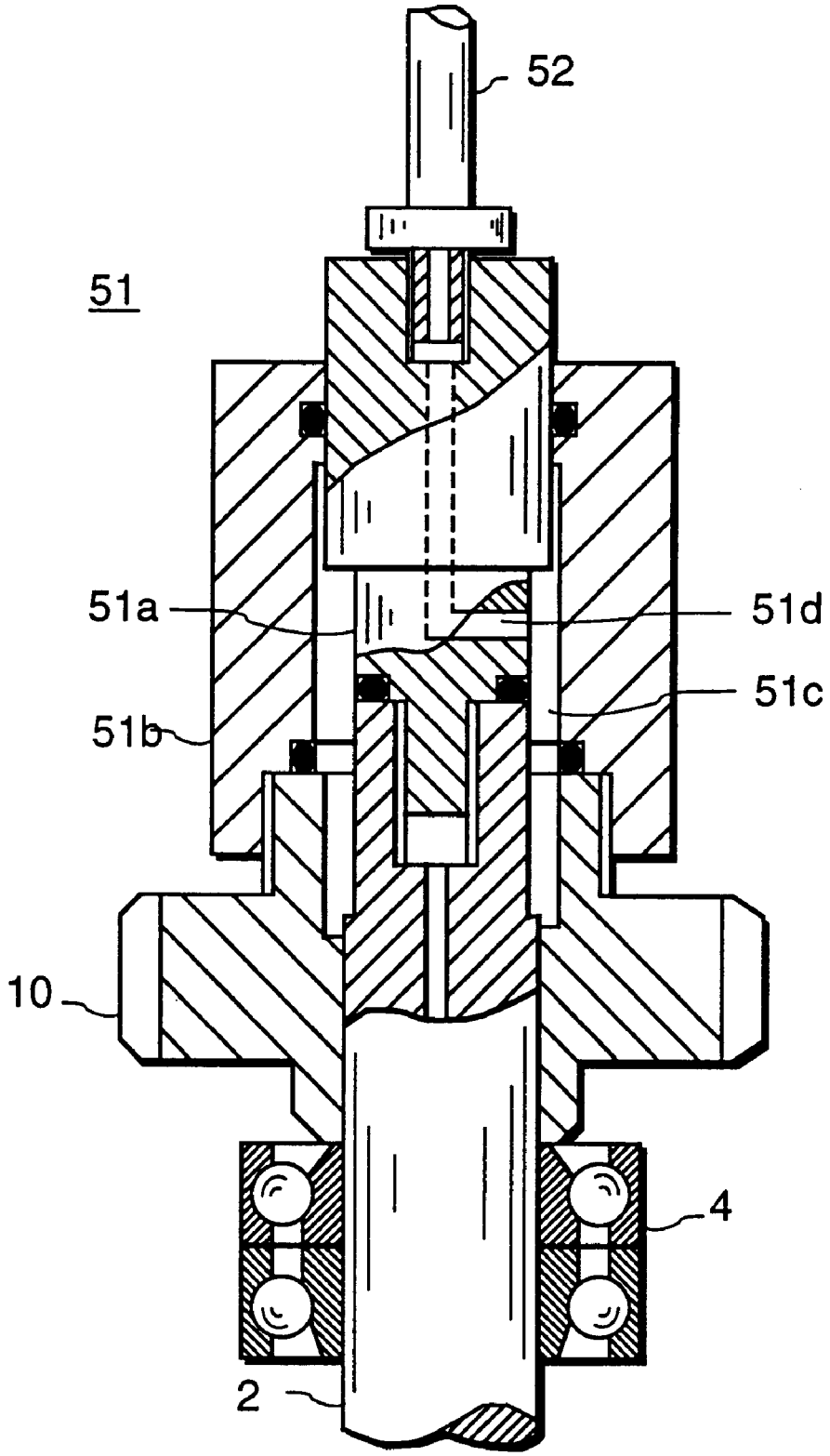
FIG. 5 is a longitudinal section view showing the state of loosing the shrink fitting of one of the timing gears on the rotor as carried out in the process shown in FIG. 4.

Next, after temporarily fixing the M-timing gear 10 to the male rotor 2 with a shrink fit, the press-fitting jig 51 is attached to the axle end portion in the delivery side of the male rotor 2 (S3). FIG. 5 shows a state in which the press-fitting jig 51 is attached to the male rotor 2.

The process to achieve the assembled state shown in FIG. 5 is as follows. The lower end threaded portion of a piston 51*a* in the press-fitting jig 51 is fastened to the upper end portion of the male rotor 2 using a threaded connection. A cylinder 51*b* of the press-fitting jig 51 is fixed to the M-timing gear 51 using a threaded connection. Then, a pipe 52 is fixed to the upper end portion of the piston 51*a* using a threaded connection. Thereby, an oil-pressure chamber 51*c* is partitioned by the M-timing gear 10, the piston 51*a* and the cylinder 51*b*. There is an inlet hole 51*d* communicating from the upper end portion of the piston 51*a* with the oil-pressure chamber 51*c*, and pressurized oil is supplied to the oil-pressure chamber 51 from the oil pressure pump 53 shown in FIG. 1. The supplying of hydraulic pressure corresponds to S4 in FIG. 4. In this step, the hydraulic pressure in the oil-pressure chamber 51*c* expands the inner diameter of the shrunk fit portion of the M-timing gear 10 with respect to the male rotor 2, and the M-timing gear 10 and the cylinder 51*b* are moved downward with respect to the male rotor 2 by the pressure difference between the hydraulic pressure in the downward direction applied onto the end surface of the M-timing gear 10 in the oil-pressure chamber 51*c* and the hydraulic pressure in the upward direction applied onto the end surface of the cylinder 51*b*. Then, the M-timing gear 10 is stopped when it is blocked by the ball bearing unit 4, and the state shown in FIG. 5 can be formed as a result.

Therein, since the M-timing gear 10 and the F-timing gear 11 are helical gears, they must rotate together along the helical teeth when the M-timing gear is moved to form the state of FIG. 5. However, when the M-timing gear 10 is rotated, the male and the female rotors 2, 3 are in contact with each other and rotation of the F-timing gear is prevented since the F-timing gear 11 is fixed to the female rotor 3. Therefore, the M-timing gear 10 tends to rotate around the male rotor 2, but there is produced a torsion between the contact point of the timing gears 10, 11 and the contact point of the both rotors 2, 3. The portion (strain) is not released because of the friction force, so that the strain remains even in the state shown in FIG. 5.

Next, in S5 of FIG. 4, the backlash, that is, the clearance between the timing gears 10, 11, is measured. In the measurement, the timing gear 11 is slightly driven using the servo motor 25, while movement of the male rotor 2 is restricted using the servo motor 24, and a phase difference between output pulses of the encoders 21, 22, and the backlash to the timing gear 10 is calculated in the MPU 30 using the phase difference.

As the clearances between the rotors 2, 3 and between the timing gears 10, 11 are measured in S2 and S4, a required symmetrizing position shown in FIG. 3, that is, G1, G2 are given taking into consideration a desired compressing performance. Thus, the adjusting work to set the positional relation of the rotors 2, 3 to clearances G1 and G2 is started.

As a preparation for the adjusting work, in S6, the timing gear 10 is fixed to the casing 1 using the fixing jig 54 shown in FIG. 1. This adjusting work performs torque control of the servo motor 24 through the D/A converter 36 in S7. At that time, the F-timing gear 11 is restricted so as to be not rotated within the backlash range of the timing gears by applying a torque toward one direction using the servo motor 25 to keep the timing gears in contact with each other.

Figure 6:
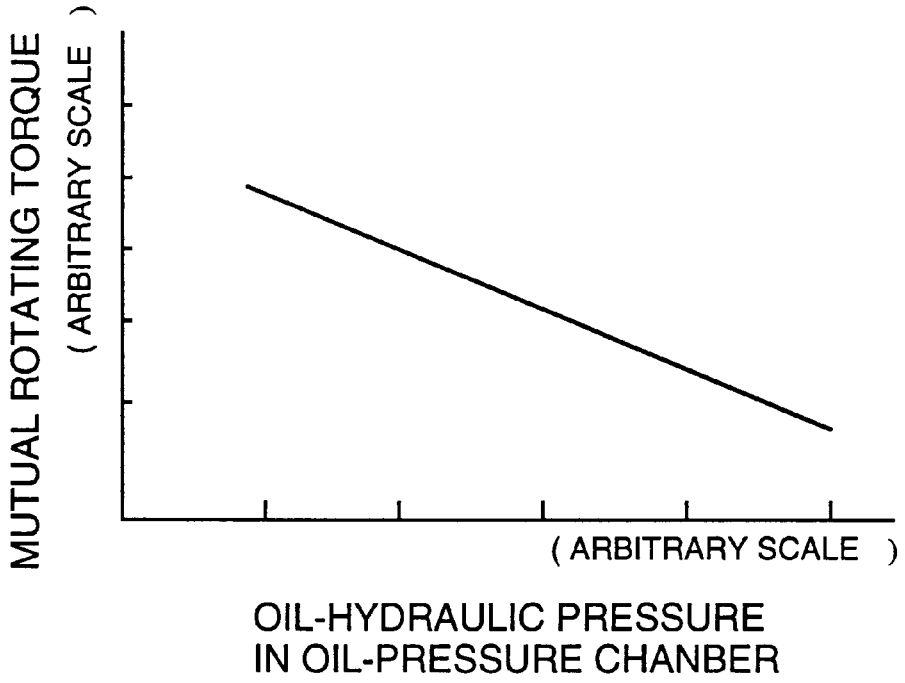
FIG. 6 is a graph showing mutual rotating torque vs. applied hydraulic pressure.

The torque control of the servo motor 24 now will be described in more detail. FIG. 6 shows the state of loosening the shrink fitting between the M-timing gear 10 and the male rotor 2, which is obtained from an experiment conducted by the present inventors. In FIG. 6, the abscissa represents oil-hydraulic pressure applied from the oil-pressure pump 53 to the oil-pressure chamber 51*c* shown in FIG. 5 and the ordinate represents a mutual rotating torque indicating at how large a torque the M-timing gear 10 begins to be rotated against the friction force with the male rotor 2 in response to the hydraulic pressure when the rotating torque is applied to the male rotor 2 using the DD motor 24 shown in FIG. 1.

In other words, even though the shrink fit between the M-timing gear 10 and the male rotor 2 is loosened by applying hydraulic pressure to the oil-pressure chamber 51*c*, there still exists some friction, and accordingly, a high shrinking force, between the M-timing gear 10 and the male rotor 2. It can be understood that due to this shrinking force the male rotor 2 is restricted from being rotated and is elastically deformed. Further, there are static friction forces between the ball bearing 4, the roller bearings 6A, 6B and the male rotor 2, and the male rotor 2 and the DD motor 24.

Figure 7:
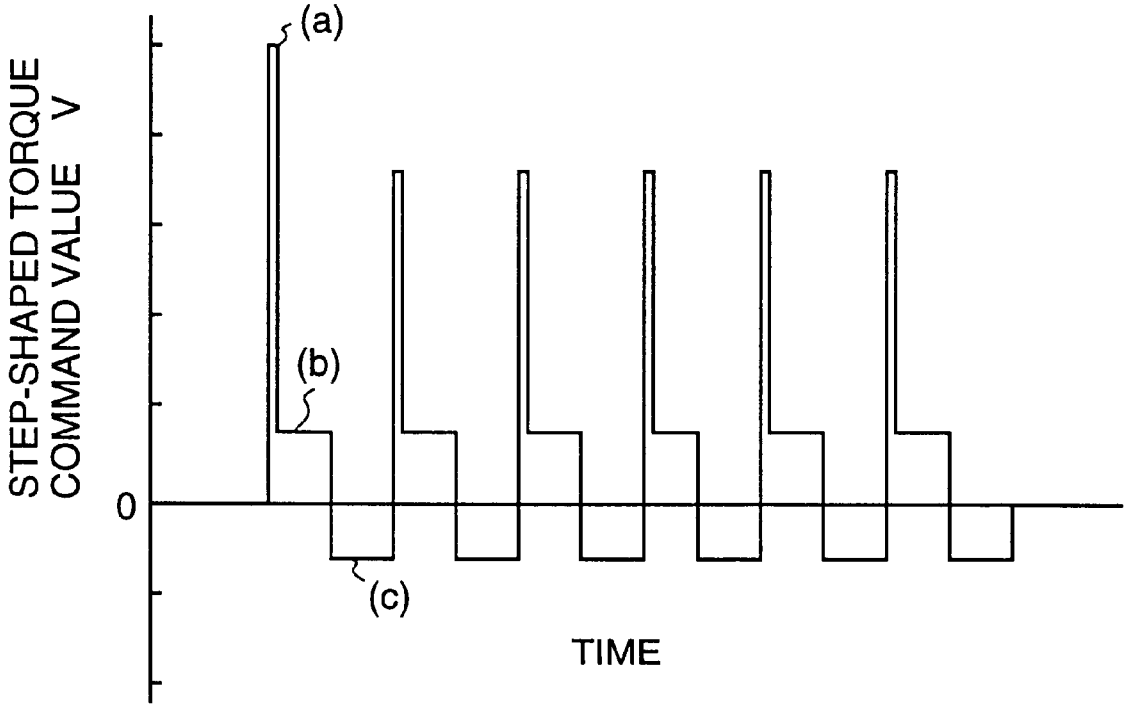
FIG. 7 is a graph for explaining a state of intermittently applying torques to the rotor through use of a servo motor in the process of FIG. 4.

Based on these facts, in S7 of FIG. 4, in accordance with the present invention, intermittent (step-shape) torques are applied to the male rotor 2 by the DD motor 24, as shown in FIG. 7. The torque command value V is determined by the MPU 30 calculating a symmetrizing target of clearance between the rotors 2, 3 (target position) in each screw compressor, a median value of relative positions of the rotors during the application of forward and backward torques ((b) and (c) in FIG. 7) which are larger than the static friction force of the driving system of the servo motor and smaller than each of the torques ((a) in FIG. 7) intermittently applied during the intermittent torque application and the characteristic curve shown in FIG. 6.

Figure 8:
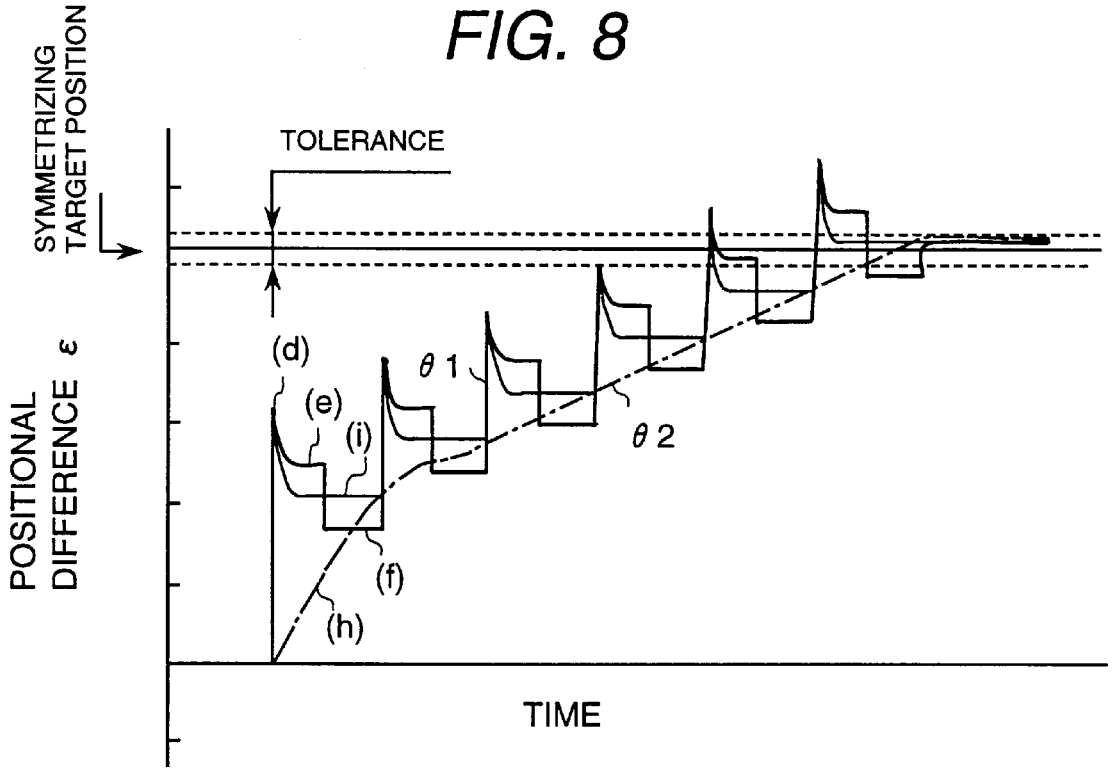
FIG. 8 is a graph showing the relationship between the position of the rotor and the target position in the intermittent torque applying operation shown in FIG. 7.

FIG. 8 shows the rotational movement (displacement) of the male rotor 2 when the torques shown in FIG. 7 are applied. In the figure, the curve θ1 represents the difference between detected results of the encoder 21 and the encoder 22, and the curve θ2 represents an envelope of the displacement of the male rotor 2 in the state in which rotation is returned by releasing of the elastic deformation in the male rotor 2.

In FIG. 8, the portion (d) denotes a rotational movement (displacement) of the male rotor 2 corresponding to the intermittently applied torque (a) in FIG. 7, and the portions (e) and (f) are rotational movements of the male rotor 2 corresponding to the forward and the backward torques (b) and (c), respectively, in FIG. 7. The portion (i) is a median value of the rotational movements (e) and (f) of the male rotor 2.

After intermittently applying torques, in S8 of FIG. 4, the MPU 30 calculates a median value (i) from outputs of the encoders 21, 22, and confirms the result using the displacement of the male rotor 2 obtained from the curve θ2 to determine whether the median value is in the symmetrizing target position. If the median value is not in the symmetrizing target position, a torque command value to be applied next is calculated based on the median value (i), that is, from the difference between the position of the male rotor 2 and the target position. Then, the processing is returned to S7 to apply the next intermittent torque. Therefore, as shown by curve θ2, the male rotor 2 is driven toward the target position through the intermittently applied torque and the forward and the backward torques, as shown by the curve θ2. The dotted lines in FIG. 8 indicate the tolerance range to the target position. If it is judged in S8 that the position of the male rotor 2 is within the tolerance range and in the symmetrizing target position, the processing advances to S9. By repeating the process of S7 and S8, the clearance of B1+B2 of FIG. 3 falls in the clearance G1+G2. As a result, all the strains produced between the rotors 2, 3, between the timing gears 10, 11 and between the male rotor 2 and the M-timing gear 10 are released.

It may be acceptable that in S7 the torque command to be applied next is calculated based on the displacement when the median value is not in the symmetrizing target position, and in S8 it is only confirmed using the displacement of the male rotor 2 whether the median value is in the symmetrizing target position. In this case, since it is empirically known how many intermittent torque applications are required to bring the median value within the tolerance range, an operator can pre-define the time required for the processing to advance to S8. In addition to this, the apparatus should be programmed such that the processing advances to S8 every time the process of S7 is executed if the processing returns from S8 to S7.

In S9 the press-fitting jig 51 and the fixing jig 54 are removed, and the processing advances to S10 to measure the clearance (backlash) of the timing gears again.

The strains, possibly produced during fixing the M-timing gear in S4, between the M-timing gear 10 and the F-timing gear 11, and the male rotor 2 are released in S5 and S7, and the M-timing gear 10 and the F-timing gear 11 are placed in a relatively free state by symmetrizing both rotors to the target position. Therefore, in this measurement, the clearance between the M- and F-timing gears 10, 11 is measured using the same method as the measuring method in S5.

In S11, the MPU 30 re-determines a final symmetrizing target position from the measured values of S2, S10. In S12 the press-fitting jig 51 is installed again, and in S13 oil-hydraulic pressure is supplied to the M-timing gear 10 through the press-fitting jig 51 to loosen the shrink fit to the male rotor 2, similar to S4. Then, the timing gear backlash is measured and the M-timing gear 10 is fixed to the casing 1 using the fixing jig 54 in the same way as in S5 and S6, though these processes are not shown in the figure. After that, in S14 and S15, the same processes as S7 and S8 are performed to set both rotors 2, 3 to the final symmetrizing target position determined in S11.

In the last, in S16, the press-fitting jig 51 and the fixing jig 54 are removed, the M-timing gear 10 is fixed to the male rotor 2 by a shrink fit, and in S17 the clearance between the M- and the F-timing gears is measured for the purpose of confirmation. In S18 a hard copy of the data is obtained using the printer 42, if necessary, and in S19 the adjusting units such as the encoders 21, 22 are removed. Thus, the series of processes is completed.

As has been described above, the clearance between the rotors can be adjusted using the MPU 54 automatically, except for the attaching and detaching of the press-fitting jig 51 and the fixing jig 54, and under a state without elastic deformation.

In FIG. 7, the forward and the backward torque application is performed by applying the forward torque (b) first and then applying the backward torque (c) in S7 and S14 of FIG. 4. However, since this process is designed to obtain the median value (i) between the rotational movements (e) and (f) of the male rotor 2 shown in FIG. 8, it is possible to apply the backward torque (c) first and then apply the forward torque (b).

Further, in S7 and S14, although the forward torque (b) and the backward torque (c) are applied during a period between the intermittent torque (a) applications, the forward torque (b) and the backward torque (c) can be omitted in a case of a screw compressor having a rotor which can be returned to its natural shape only by the intermittent application of torque.

Figure 9:
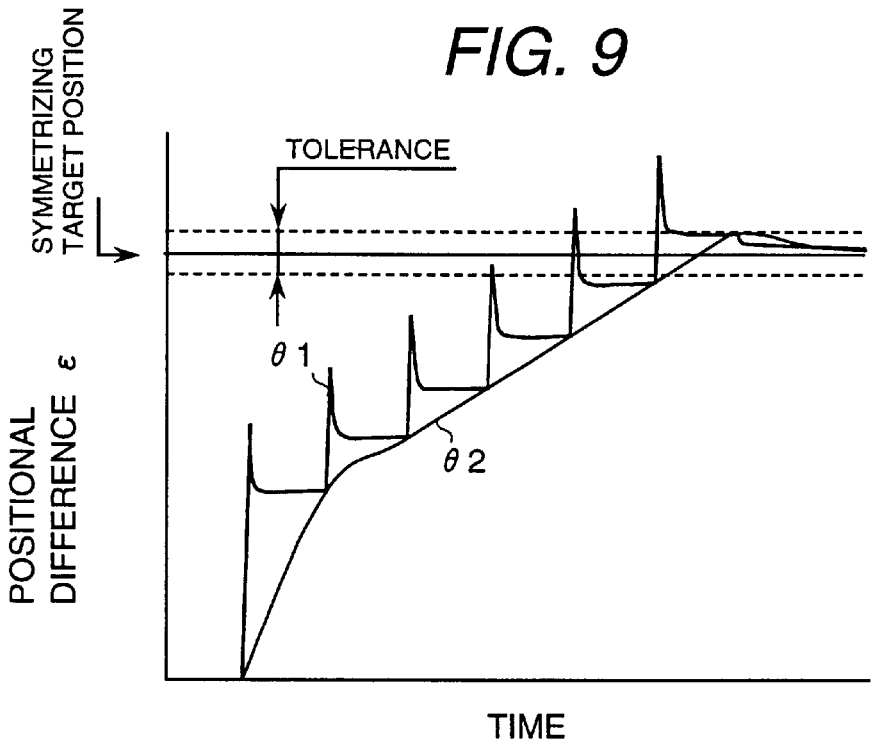
FIG. 9 is a graph showing the relationship between the position of the rotor and the target position in a case where torques are intermittently applied to the rotor using a servo motor in the process of FIG. 4 in a different way from that shown in FIG. 7.

FIG. 9 shows the rotational movement (displacement) of the male rotor 2 in a case where only the intermittent torques are applied and the forward and the backward torques are omitted.

In FIG. 9, the curve θ1 represents difference between detected results of the encoder 21 and the encoder 22, and the curve θ2 is an envelope of the displacement of the male rotor 2 in the state in which rotation is returned by releasing the elastic deformation in the male rotor 2.

In this case, in S8 and S15 of FIG. 4, using the displacement of the male rotor 2 obtained from the curve θ2 under a condition where the torque is not applied to the male rotor 2, it is confirmed whether the median value is in the symmetrizing target position. If the median value is not in the symmetrizing target position, a torque command value to be applied next is calculated based on the median value, that is, from the difference between the position of the male rotor 2 and the target position. Then, the processing is returned to S7 in the case of S8, and to S14 in the case of S15 to apply the next intermittent torque. Thereby, the male rotor 2 is driven toward the target position. The description of the other processes will be omitted here since they are the same as those in FIG. 4.

Press-fitting of the M-timing gear shown by S4 of FIG. 4 now will be described. In a case where the M-timing gear 10 is press-fit to the male rotor 2 after press-fitting (inserting) the F-timing gear 11 to the female rotor 3, since the timing gears 10, 11 are helical gears, both of the timing gears 10, 11 are rotated counterclockwise together while sliding along the helical teeth. Therefore, the male rotor 2 and the female rotor 3, which cannot be moved in the axial direction, are sometimes in contact with each other (a condition hereinafter referred to as "clash") and the rotors 2, 3 are twisted.

When clash occurs, excessively large forces act between the rotors 2, 3 and between the timing gears 10, 11. Therefore, there is a possibility that damage may occur to the rotors 2, 3 and in the timing gears 10, 11, that damage may occur in each of the bearings shown in FIG. 1 and in the other bearings not shown, and that the axial span between the rotors 2, 3 may be expanded.

When the symmetrizing adjustment is performed under a condition that a shrink fit between the male rotor 2 and the M-timing gear 10 is loosened by applying oil pressure and the M-timing gear 10 is fixed to the casing 1 with the jig 54, the M-timing gear 10 is sometimes tilted in the conventional technology.

That is, when the screw of the jig 54 is fastened, a force acts on the male rotor 2 in the direction intersecting at a right angle to the axial direction of the rotors 2, 3 to tilt the M-timing gear 10, and the M-timing gear is, thereby, displaced in the radial direction and in the thrust direction at the engaging position of the timing gears 10, 11. As a result, the F-timing gear 11 is rotated. Since the female rotor 3 is also rotated with the rotation of the F-timing gear, the rotors 2, 3 are in contact with each other depending on the magnitude of the rotation. Since the gap (backlash) between the rotors 2, 3 is as small as several tens of micro-meters (equivalent to 0.15° in rotational angle), even a very small tilting produces a bad effect on the accuracy of the symmetrizing adjustment.

Figure 10:
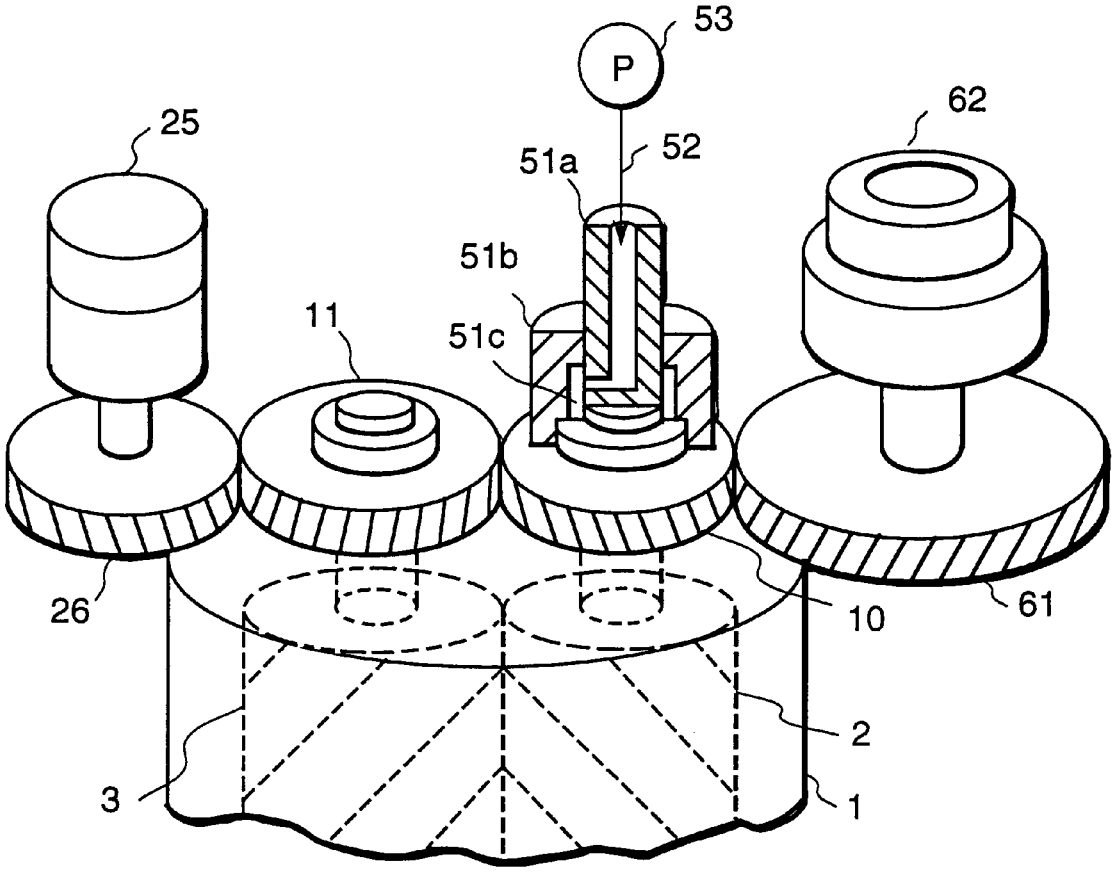
FIG. 10 is an enlarged perspective view of the timing gear portion showing the operation of press-fitting an M-timing gear of the screw compressor shown in FIG. 1.

FIG. 10 shows an example of the press-fitting of an M-timing gear. Referring to FIG. 10, the reference character 61 denotes an outer gear which is an alternative to the jig 54 shown in FIG. 1, and the reference character 62 denotes a DD motor for driving the outer gear 61.

The process of fixing the M-timing gear 10, the piston 51*a* and the cylinder 51*b* of the press-fitting jig 51 is the same as the process described with reference to FIG. 5. That is, the lower end screw portion of a piston 51*a* in the press-fitting jig 51 is fastened to the upper end portion of the male rotor 2 using a threaded condition. A cylinder 51*b* of the press-fitting jig 51 is fixed to the M-timing gear 51 using a threaded connection. Then, a pipe 52 is fixed to the upper end portion of the piston 51*a* using a threaded connection. Thereby, an oil-pressure chamber 51*c* is partitioned by the M-timing gear 10, the piston 51*a* and the cylinder 51*b*. On the other hand, in this arrangement, the outer gear 61 is engaged with the M-timing gear 10.

Figure 11A:
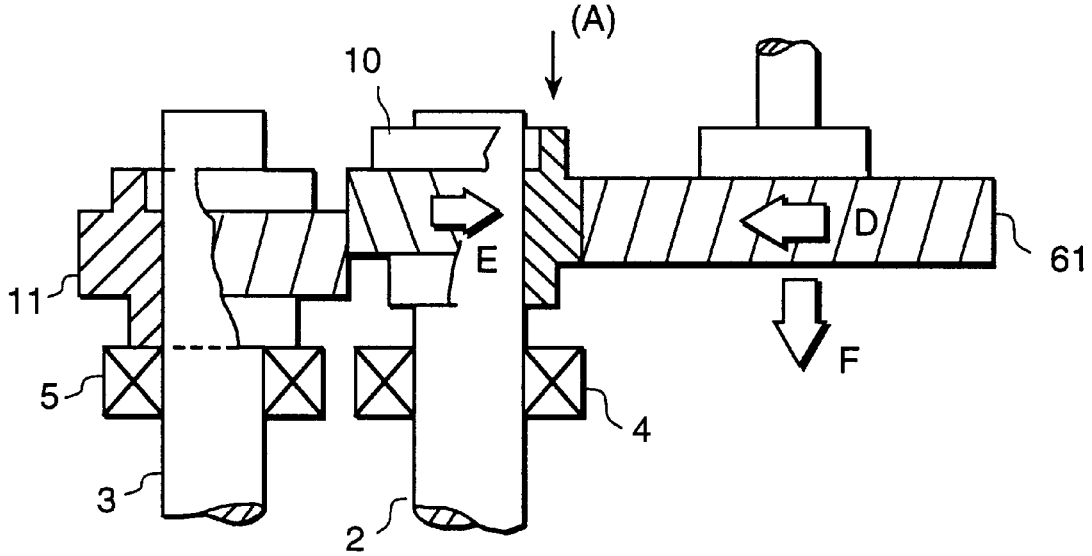
Figure 11B:
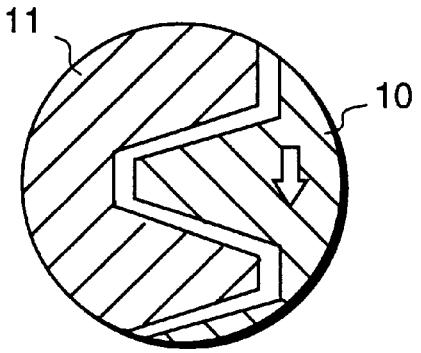
Figure 11C:
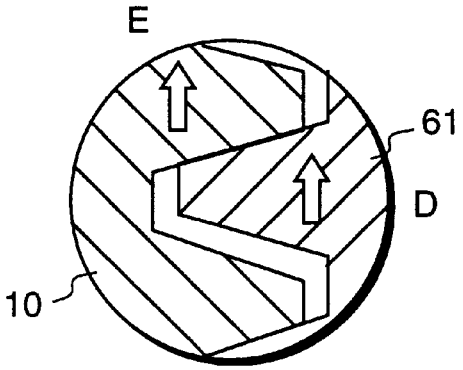

Next, hydraulic pressure is applied to the M-timing gear 10 is the same manner as used in the conventional press-fitting to loosen the shrink fit by expanding the inner diameter of the timing gear, and at the same time a thrust force (press fitting) is applied in the direction shown by the arrow A in FIG. 11. Thereby, the M-timing gear 10 is engaged with the helical teeth of the F-timing gear 11. At that time, the M-timing gear 10 is rotated using the outer gear 61, as shown by the arrow D of FIG. 11A. In response, the M-timing gear 10 is rotated, as shown by the arrow E, and is moved and twisted in the inclined direction of the helical teeth of the F-timing gear 11. The DD motor 62 and the outer gear 61 are moved in synchronization with the moving speed of the M-timing gear 10, as shown by the arrow F, so that the rotating force is sufficiently transmitted from the outer gear 61 to the M-timing gear 10. By doing so, the M-timing gear 10 is press-fit to the male rotor 2 by being pushed by the outer gear 61, as shown in FIG. 11C, while both timing gears 10, 11 maintain a gap, as shown in FIG. 11B. Further, the male rotor 2 is about to rotate as the M-timing gear 10 is being press-fit to the male rotor 2, but the rotors 2, 3 are not in contact with each other as shown in FIG. 12B due to the application of torque in the direction shown by the arrow G opposite to the rotating direction of the M-timing gear 10 using the DD motor 24, as schematically shown in FIG. 12A.

In order to synchronize the moving speed of the M-timing gear 10 in the direction A with the moving speed of the outer gear 61 in the direction F, a position sensor is arranged in the oil pressure cylinder 51*b* and the movements of the outer gear 61 and the DD motor 62 are controlled using the detected result. The rotating angle of the outer gear 61 toward the direction D, that is, the controlled amount of movement of the DD motor 62 may be determined from the moving speed of the outer gear 61 toward the direction F based the skew angle of the M-timing gear 10.

Figure 12A:
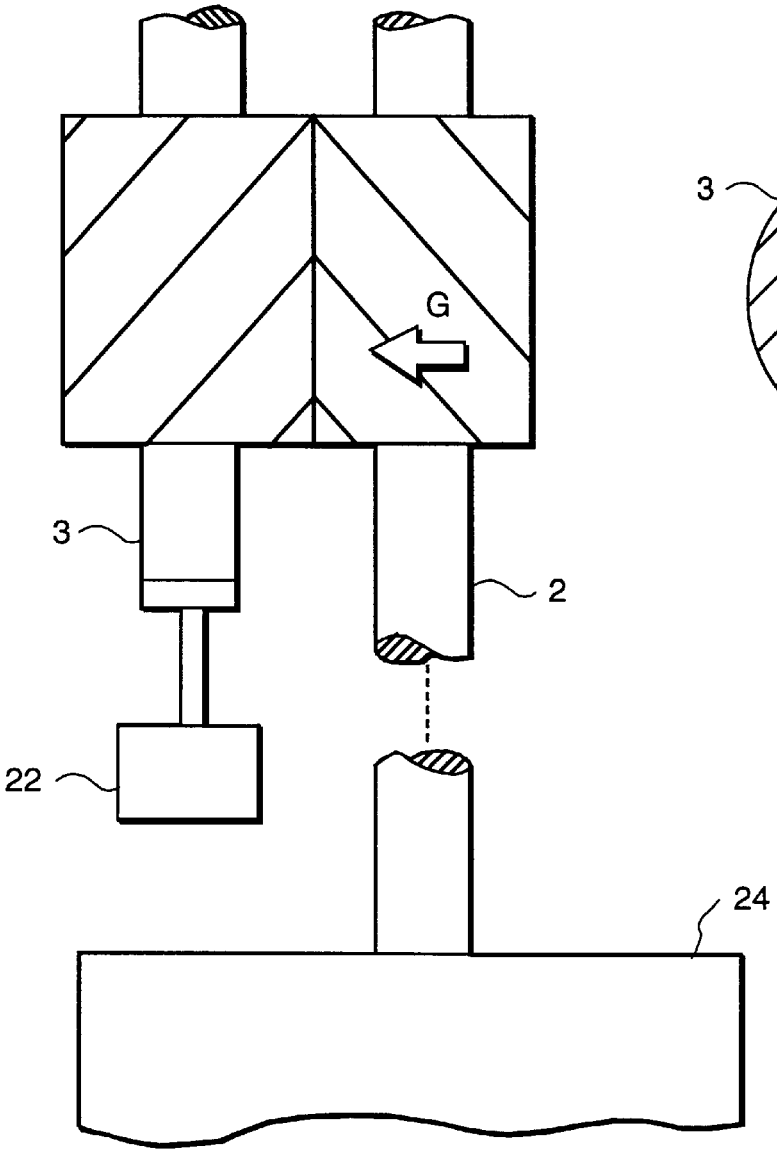
Figure 12B:
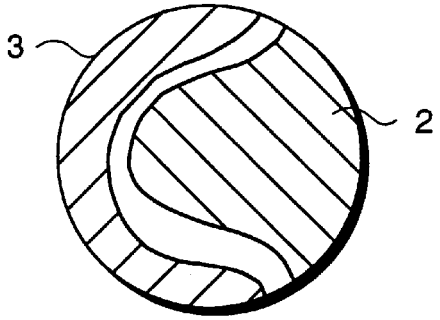

Although the encoder 21 detecting rotation of the male rotor is not shown in FIG. 12A, the two values of the rotating angles $f1$ and $f2$ detected by the encoders 21, 22 are measured, and the difference between the two values is calculated. When the calculated result is larger than the backlash between the gear 26 and the F-timing gear 11, it is judged that clash occurs. It is also possible from the positive or negative sign of the calculated result to judge the direction of clash. Instead of detecting the rotating angle $\theta 2$ using the encoder 22, it is possible to provide an encoder in the servo motor 25 and use its output.

The symmetrizing adjustment of both rotors 2, 3 now will be described. In the symmetrizing adjustment, the female rotor 3 has a braking force applied thereto by the servo motor 25 to prevent it from being rotated, and the male rotor 2 is rotated by the DD motor 24. In this case, the M-timing gear 10 has a braking force applied thereto by the DD motor 62 through the outer gear 61 so that it is not rotated. That is, by keeping the DD motor 62 in a stopped state by applying braking during the symmetrizing adjusting, movement of the M-timing gear 10 engaging with the outer gear 61 is also restricted in the rotating direction so that the engaging problem of the M-timing gear 10 and the F-timing gear 11 does not occur. To achieve this clamping, no additional external force which is liable to change the distance between axles is applied onto the M-timing gear 10, and accordingly no bad effect on the accuracy of symmetrizing adjustment occurs.

Although the F-timing gear 11 is press-fit to the female rotor 3 prior to press-fitting the M-timing gear 10 in the above-mentioned embodiments, the M-timing gear 10 may be press-fit to the male rotor 2 prior to fitting the F-timing gear 11 to the female rotor 3. Further, the symmetrizing adjustment may be performed by restricting the male rotor 2 using the DD motor 24 and applying a torque to the female rotor 3 using the servo motor 25 or the DD motor 62.

As has been described above, according to the present invention, it is possible to adjust the clearance of rotors of a screw compressor without causing problems such as the occurrence of flaws in the timing gears, damage of the bearings and an expanding axle distance between the rotors.

Further, according to the present invention, it is possible to adjust the clearance of rotors of a screw compressor without producing a bad effect on the accuracy of the symmetrizing adjustment.

Furthermore, according to the present invention, it is possible to set the very small clearance between both rotors to a desired value within a short time and to provide a screw compressor which exhibits high reliability in the symmetrizing adjustment and a high compression performance.

What is claimed is:

1. A method of adjusting an engaged clearance between rotors of a screw compressor having a male rotor and a female rotor inside a casing, both of the rotors being rotated while maintaining a required very small clearance therebetween using timing gears fixed individually to the rotors through shrink fitting, the method comprising the steps of:

loosening the shrink fitting between one of said timing gears and the rotor on which the one of said timing gears is mounted, while movement of the other of said timing gears is being restricted; and intermittently applying torques to said rotor on which the one of said timing gears is mounted using a servo motor to set the very small clearance between the rotors to a required value.

2. A method of adjusting an engaged clearance between rotors of a screw compressor according to claim 1, wherein in the application of intermittent torques to said rotor on which the one of said timing gears is mounted, a torque value to be applied next time is determined from a difference between a position of said rotor and a target position to set the very small clearance between the rotors to the required value.

3. A method of adjusting an engaged clearance between rotors of a screw compressor according to claim 1, wherein the intermittent torques applied to said rotor are applied onto an end portion of said rotor opposite to an end portion at which the one of said timing gears is attached.

4. A method of adjusting an engaged clearance between rotors of a screw compressor according to claim 1, the method further comprising the steps of:

applying torques in forward and backward directions to said rotor during said intermittent torque application, each of said forward and backward applied torques being larger than a static friction force of the driving system of said servo motor and smaller than each of the torques intermittently applied;

calculating a median value of relative positions of said rotors during the application of said forward and backward applied torques; and calculating a command value of an intermittent torque to be applied next from a difference between said median value and said required value for the very small clearance between the rotors.

5. A method of adjusting an engaged clearance between rotors of a screw compressor according to claim 4, wherein application of said forward applied torque is performed after applying said backward torque application.

6. A method of adjusting an engaged clearance between rotors of a screw compressor according to claim 4, wherein the forward and backward applied torques are applied onto an end portion of said rotor opposite to an end portion at which the one of said timing gears is attached.

7. A method of adjusting an engaged clearance between rotors of a screw compressor according to claim 1, where each of the timing gears is a helical gear, the method further comprising the steps of:

fixing a first timing gear which has been precidently press-fit so that it can not be rotated;

engaging a second timing gears to be press-fit later than said first timing gear, with helical teeth of an outer gear;

rotating the second timing gear toward the direction in which the first and second timing gears engage each other using said outer gear; and at the same time, fixing the rotor to be press-fit in the second timing gear so that it is not rotated.

8. A method of adjusting an engaged clearance between rotors of a screw compressor according to claim 7, the method further comprising the steps of:

providing a direct drive motor and an encoder to each of the rotor which has been press-fit with the first timing gear with the rotor and to be press-fit with the second timing gear later; and fixing the rotors so that they can not be rotated by controlling each of the direct drive motors using output power from each of the encoders.

9. A method of adjusting an engaged clearance between rotors of a screw compressor according to claim 7, the method further comprising the steps of:

loosening the shrink fit between the second timing gear and the rotor on which the second timing gear is mounted;

stopping rotation of said second timing gear using the outer gear engaging with said second timing gear; and adjusting the small clearance between the male and the female rotors using a direct drive motor coupled to said rotor.

10. An apparatus for adjusting an engaged clearance between rotors of a screw compressor having a male rotor and a female rotor inside a casing, both of the rotors being rotated while maintaining a required very small clearance therebetween using timing gears fixed individually to the rotors through shrink fitting, which further comprises:

intermittent torque applying means for loosening the shrink fit between one of said timing gears and the rotor on which the one of said timing gears is mounted, while movement of the other of said timing gears is being restricted, and for intermittently applying torques based on command values to said rotor on which the one of said timing gears is mounted on a servo motor.

11. An apparatus for adjusting an engaged clearance between rotors of a screw compressor according to claim 10, which further comprises:

intermittent torque calculating means for calculating said command value of the intermittent torque to be applied next time from a difference between a position of said rotor and a target position to set the very small clearance between the rotors to a required value.

12. An apparatus for adjusting an engaged clearance between rotors of a screw compressor according to claim 10, which further comprises:

forward and backward torque applying means for applying torques in forward and backward directions to said rotor during said intermittent torque application, each of said forward and backward applied torques being larger than a static friction force of the driving system of said servo motor and smaller than each torque intermittently applied;

relative position median value calculating means for calculating a median value of relative positions of said rotors during the application said forward and backward applied torques; and intermittent torque calculating means for calculating said command value of an intermittent torque to be applied next from a difference between said median value and a required value for the very small clearance between the rotors.

* * * * *